United States Patent [19]

Mizuno et al.

[11] 4,182,610

[45] Jan. 8, 1980

[54] WATER-COOLED FURNACE COVER

[75] Inventors: Susumu Mizuno, Nagoya; Hiroshi Imagawa, Tajimi, both of Japan

[73] Assignee: Daidotokushuko Kabushikikaisha, Japan

[21] Appl. No.: 876,072

[22] Filed: Feb. 8, 1978

[30] Foreign Application Priority Data

Feb. 8, 1977 [JP] Japan ..... 52-12856
Feb. 8, 1977 [JP] Japan ..... 52-12857

[51] Int. Cl.[2] ..... F27D 1/12
[52] U.S. Cl. ..... 432/237
[58] Field of Search ..... 432/237, 250; 110/180

[56] References Cited

U.S. PATENT DOCUMENTS 3,601,379 8/1971 Langlitz ..... 432/237
3,705,717 12/1972 Hadberg ..... 110/180 X

*Primary Examiner*—John J. Camby
*Attorney, Agent, or Firm*—William A. Drucker

[57] ABSTRACT

A water-cooled furnace cover comprising a plurality of jackets each internally provided with a water channel. These jackets are arranged side by side to form a body portion of the cover. A number of fins extend from a surface of the body portion facing the interior of the furnace so that a slag layer may be adhered to the fins to easily form a heat insulating layer.

5 Claims, 5 Drawing Figures

WATER-COOLED FURNACE COVER

BACKGROUND OF THE INVENTION

1. Field of the Invention

This invention relates to water-cooled furnace covers, which can be attached to cover steel-making or smelting furnaces such as arc furnaces, plasma furnaces, induction furnaces and the like.

2. Description of the Prior Art

Recently, many improvements have been proposed in an effort to extend the service life of the furnace cover.

For example, in a furnace cover formed of fire bricks, even if cooling water is passed through the interior thereof, it is difficult to considerably decrease a degree of wear of the surface thereof.

In order to overcome this, one method has been proposed in which the body portion of the furnace cover is formed of steel material instead of using the fire bricks and to internally cool the steel material. This proposal, however, gives rise to a problem in which radiant heat increases in quantity because the steel material is high in coefficient of heat-transfer.

In view of the above, another proposal has been made in which a layer of oxide film or castable material is applied to a surface of the furnace cover opposite to the interior of the furnace for the purpose of heat insulation. This arrangement suffers, however, from a problem that slags occurring within the furnace during the operation of steel making are scattered so that the slags are adhered to the aforementioned layer and then the slags gradually form into a large mass, and as a consequence, when the massive slag falls by the gravity thereof, the aforesaid insulating layer is forced to be peeled off.

SUMMARY OF THE INVENTION

It is therefore an object of the present invention to provide a furnace cover, which is designed so that water is passed through a body portion of the furnace cover exposed to high temperature thereby internally cooling those portions in the furnace cover exposed to high temperature.

It is another object of the invention to provide a furnace cover in which slags resulting from splashes within the furnace may be successively adhered to portions in the body portion in the furnace cover exposed to high temperature so as to form a thick and heat-insulative slag layer in the surface of the furnace cover oppostite to the interior of the furnace.

It is a further object of the invention to provide a furnace cover in which even if the slags adhered to the surface of the body portion in the furnace cover opposite to the interior of a furnace fall, slag layer of the thickness enough to provide heat insulation of the body portion of the furnace cover always remains present.

It is still another object of the invention to provide a furnace cover in which when the body portion of the furnace cover is partly damaged and such a defective portion must be repaired, only the damaged jacket among jackets, which constitute a body portion of the furnace cover and are each provided with an independent water channel, may be replaced with a new one without modification of water channels in other jackets.

DESCRIPTION OF THE PREFERRED EMBODIMENTS

Figure 1:
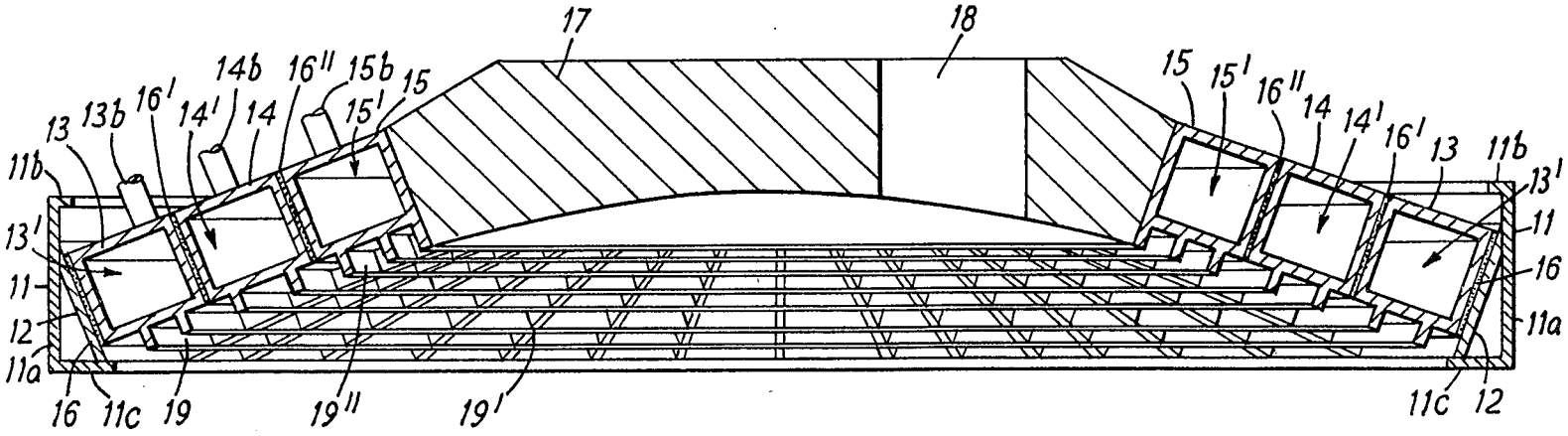
FIG. 1 is a longitudinal sectional view showing one embodiment of a water-cooled furnace cover.
Figure 2:
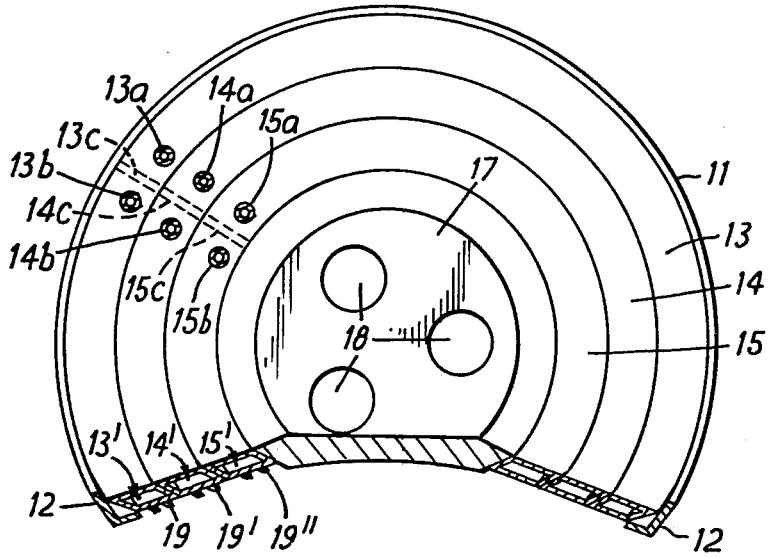
FIG. 2 is a partly cutaway plan view of the furnace cover shown in FIG. 1.

Turning now to FIGS. 1 and 2 there is shown a water-cooled furnace cover comprising a body portion, which includes an annular frame 11 and a plurality of jackets 13, 14 and 15, and a small ceiling 17.

First, the annular frame 11 comprises a body portion 11*a* and flanges 11*b* and 11*c* connected to an upper end and a lower end, respectively, of the body portion 11*a*, these elements being integrally formed by steel material. It will be understood that the flanges 11*b* and 11*c* are provided to reinforce the body portion 11*a*. The annular frame 11 is internally provided with an annular seat frame 12. This seat frame 12 is tapered so that an uppr end thereof has a diameter larger than a diameter of a lower end thereof.

The seat frame 12 is formed of a steel material and has the upper end welded to the body portion 11*a* whilst the lower end is welded to the flange 11*c*.

Next, the jacket 13 comprises a hollow square member formed into an annular configuration, which is interiorly formed with a water channel 13'. The jacket 13 has an outer peripheral surface formed to be tapered to have the same inclination as that of the seat frame 12 and a clearance between the outer peripheral surface and the seat frame 12 is filled with asbestos 16. This jacket 13 has an inner peripheral surface, which is also tapered so that an upper end thereof has a diameter larger than that of a lower end thereof. The jacket 13 has its upper surface provided with an inlet 13*a* for cooling water and an outlet 13*b* therefor. The jacket 13 is interiorly provided with a partitioning plate 13*c* so as to prevent the cooling water entered through the inlet 13*a* from being directly passed toward the outlet 13*b*. To the lower surface of the jacket 13 are mounted a plurality of fins 19. These fins 19 are provided so that during the operation of the furnace, which will be described hereinafter, splashes within the furnace may be easily adhered to the lower surface of the jacket 13 and a slag layer created by adherence of the splashes thereto will not easily peel off. Spacing between numerous fins 19, 19 . . . and extended dimension thereof are such that even when the slag layer adhered to the lower surface of the jacket 13 is peeled off, a part thereof remains adhered.

Another jacket 14 is constructed similarly to the jacket 13 with the exception of its diameter and has its lower surface formed with fins 19'. Asbestos 16' similar to that previously described is filled between the jacket 14 and the jacket 13.

A jacket 15 is likewise constructed and has its lower surface formed with fins 19''. Asbestos 16'' is also filled between the jacket 15 and the jacket 14. If desired, the fins 19, 19', and 19'' may be integrally connected by fins, which extend in an interconnecting direction. It will be noted in the aforementioned jackets 14 and 15 that parts corresponding to the parts in the jacket 13 bear like reference characters "a", "b" and "c" so that repeated explanations will not be made. It will be further noted that the number of these jackets may be increased to more than as is illustrated in the figures.

Next, a small ceiling 17 is formed of a refractory material such as fire bricks.

The small ceiling 17 has its outer peripheral surface tapered as in the inner peripheral surface of the jacket 15. The small ceiling 17 is formed in a central portion thereof with holes 18, 18 . . . to receive therein an electrode rod in case of an arc furnace and a plasma torch in case of a plasma furnace. The number of these holes is the same number as that of electrode rods.

A procedure for assembly of the cover as described above will be explained hereinafter.

First, the frame 11 with the seat frame 12 mounted thereon is prepared. Next, the asbestos 16 is laid on the inner peripheral surface of the seat frame 12. Then, the jacket 13 is fitted in the inside thereof from above in FIG. 1. The asbestos 16' is then laid on the inner peripheral surface of the jacket 13. The jacket 14 is likewise fitted in the inside thereof. The asbestos 16" is similarly laid on the inner peripheral surface of the jacket 14 and the jacket 15 is fitted therein. Finally, the small ceiling 17 is slipped in the jacket 15 to complete the cover.

The thus finished cover is placed to cover the furnace in a known manner and electrodes are inserted into the holes 18 for operation of the furnace.

When the furnace is operated, cooling water is introduced through inlets 13*a*, 14*a* and 15*a*. The cooling water passes through the water channels 13', 14' and 15' to cool the jackets 13, 14 and 15 and is discharged through outlets 13*b*, 14*b* and 15*b*. Thus, this prevents the jackets 13, 14 and 15 from being overheated.

During the operation of the furnace, there occur splashes within the furnace and slags are gradually adhered to the lower surfaces of the jackets 13, 14 and 15 and to the fins 19, 19' and 19" and accumulated thereon. Thus, such adherence and accumulation of the slags are formed into a slag layer. This slag layer prevents the lower surfaces of the jackets 13, 14 and 15 and fins 19, 19' and 19" from being directly exposed to high temperature heat of the furnace. That is, the slag layer serves as a heat insulating layer.

Figure 4:
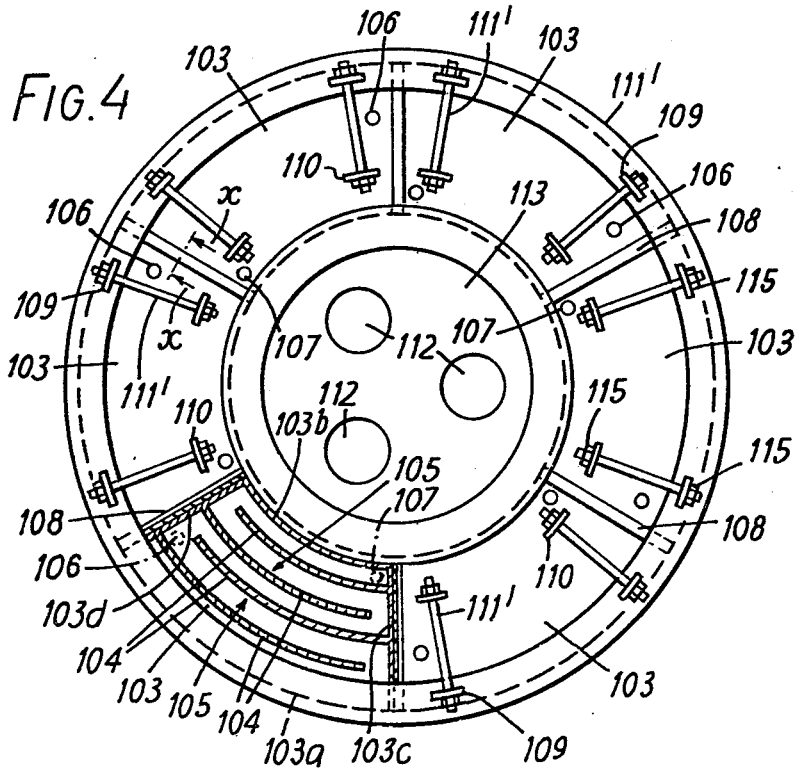
FIG. 4 is a plan view of the furnace cover shown in FIG. 3.
Figure 3:
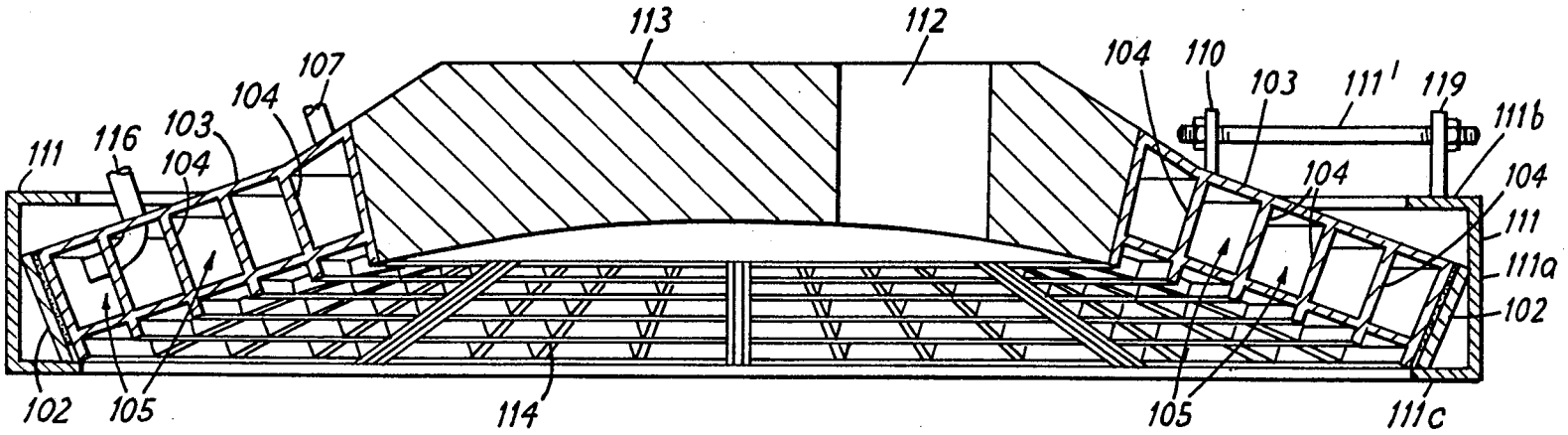
FIG. 3 is a longitudinal sectional view showing another embodiment of the water-cooled furnace cover.
Figure 5:
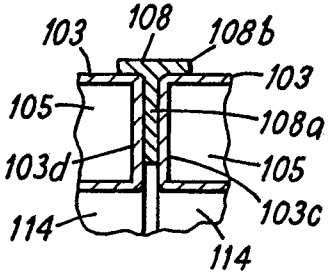
FIG. 5 is a fragmentary sectional view taken along the line x—x in FIG. 4.

Referring now to FIGS. 3 through 5 showing a modified form of embodiment, there is shown a modified construction of a body portion in the furnace cover. That is, the body portion comprises an annular frame 111, a seat frame 102, and a plurality of jackets 103, 103 . . . arranged internally thereof. The annular frame 111 has a construction equal to that of the frame 11 described in conjunction with the previous embodiment and comprises a body portion 111*a* and flanges 111*b* and 111*c*. The seat frame 102 also has a construction equal to that of the seat frame 12 as previously described.

The jacket 103, which is formed of steel plates, is formed into a hollow configuration. The jacket 103 is configurated, as shown, such that an outer peripheral surface 103*a* is convex while an inner peripheral surface 103*b* is concave, the outer peripheral surface 103*a* having a length greater than that of the inner peripheral surface 103*b*, and sides 103*c* and 103*d* being plane. The outer peripheral surface 103*a* has its curve identical to the shape of the seat frame 102 whereas the inner peripheral surface 103*b* has its curve identical to the shape of the outer peripheral surface of the small ceiling later described.

The jacket 103 is interiorly provided with a plurality of baffles 104 with a zigzag water channel 105 formed therein. Mounted on the jacket 103 are an inlet pipe 106 and an outlet pipe 107 through which cooling water flows, said inlet pipe and outlet pipe being communicated with one end and the other end, respectively, of the water channel 105.

The jacket 103 has its lower surface formed with fins 114, which are designed in a manner similar to the above-mentioned fins 19. The jacket 103 is supported on a support member. That is, a bracket 109 extends from the upper surface of a flange 111*b* on a frame 111 and another bracket 110 also extends from the upper surface of the jacket 103, said brackets 109 and 110 being connected with each other by means of a connecting rod 111' and a nut 115 screwed thereon, thus supporting the jacket 103. A blocking member 108, which is formed of a stainless material, is interposed between adjacent ones of a plurality of jackets 103. The blocking member 108 comprises an element 108*a*, which is disposed between a side 103*c* of one of the adjacent jackets 103 and 103 and a side 103*d* of the other jacket 103, and another element 108*b* to cover the upper surfaces of these jackets 103, 103.

In this embodiment, a small ceiling 113 is designed similarly to the small ceiling 17 in the first embodiment, and a hole 112 designed similarly to the hole 18 in the first embodiment.

The furnace cover constructed as described above may be assembled in the following manner. Internally of the seat frame 2 are successively disposed a number of jackets 103, which are respectively supported by support members. It should be noted that the jackets 103 may be set in position as described above either from above of the annular frame 11 or from below thereof. Once all the jackets 103 are arranged internally of the seat frame 102 and the blocking members 108 are respectively interposed between the jackets 103, individual jackets 103 may be fixedly positioned irrespective of squeezing of not only the support members but the jackets 103 from one another.

Then, the small ceiling 113 is fitted internally of the thus completed body portion to complete the furnace cover.

Since the blocking members 108 are interposed between the adjacent ones of the jackets 103, if the furnace cover completed as described above is used in a manner similar to the first embodiment, high temperature gases within the furnace may be prevented from being directly blown out through clearances between the jackets 103, even if such blow-out should occur, because of the provision of the blocking members 108, to thereby minimize a loss of heat within the furnace.

What is claimed is:

1. A water-cooled furnace cover having a body portion with a plurality of jackets each including an internal water channel, said jackets being arranged side by side, and a number of fins in the form of a lattice extending from a surface of said body portion facing the interior of the furnace.

2. A water-cooled furnace cover, as claimed in claim 1, wherein each jacket is a hollow annulus, the plurality of jackets being concentrically disposed.

3. A water-cooled furnace cover, as claimed in claim 1, wherein each jacket is a segment of an annulus, a convex radially outer circumferential surface of the jacket being of greater angular extent than a concave radially inner circumferential surface of the jacket, the plurality of segmental jackets being disposed side by side to form a complete annulus.

4. A water-cooled furnace cover, as claimed in claim 2, wherein each jacket has a surface facing the interior of the furnace and provided with a plurality of said fins independent of the fins of the other jackets.

5. A water-cooled furnace cover, as claimed in claim 3, wherein each segmental jacket has a surface facing the interior of the furnace and provided with a plurality of said fins independent of the fins of the other jackets.

* * * * *